US008269478B2

(12) United States Patent
Chao et al.

(10) Patent No.: US 8,269,478 B2
(45) Date of Patent: Sep. 18, 2012

(54) TWO-TERMINAL VOLTAGE REGULATOR WITH CURRENT-BALANCING CURRENT MIRROR

(75) Inventors: Hio Leong Chao, Tucson, AZ (US); A. Paul Brokaw, Tucson, AZ (US)

(73) Assignee: Analog Devices, Inc., Norwood, MA (US)

( * ) Notice: Subject to any disclaimer, the term of this patent is extended or adjusted under 35 U.S.C. 154(b) by 670 days.

(21) Appl. No.: 12/157,472

(22) Filed: Jun. 10, 2008

(65) Prior Publication Data

US 2009/0302822 A1 Dec. 10, 2009

(51) Int. Cl.
*G05F 3/16* (2006.01)

(52) U.S. Cl. ..... 323/315; 323/313; 327/539

(58) Field of Classification Search ..... 323/312, 323/313, 314, 315, 907; 327/538, 539, 540, 327/541, 542, 543
See application file for complete search history.

(56) References Cited

U.S. PATENT DOCUMENTS

| | | | | |
|---|---|---|---|---|
| 3,617,859 | A | 11/1971 | Dobkin et al. | 323/4 |
| 4,396,883 | A * | 8/1983 | Holloway et al. | 323/313 |
| 5,523,709 | A | 6/1996 | Phillips et al. | 327/143 |
| 6,172,555 | B1 | 1/2001 | Gusinov | 327/539 |
| 6,300,752 | B1 * | 10/2001 | Mack | 323/313 |
| 7,208,930 | B1 * | 4/2007 | Tran et al. | 323/314 |
| 7,372,242 | B2 * | 5/2008 | Xi | 323/313 |

FOREIGN PATENT DOCUMENTS

JP 61029917 2/1986

OTHER PUBLICATIONS

Camenzind, Hans; "Designing Analog Chips"; Chapter 7: Bandgap References; Feb. 2005; pp. 7-1 through 7-14.
PCT Notification of the International Search Report and the Written Opinion of the International Searching Authority, Dated Sep. 9, 2009; for International Application No. PCT/US2009/003385.
Widler, R.J., "New Developments in IC Voltage Regulators", IEEE International Solid-State Circuits Conference (1970), p. 158.
Analog Devices, DACPORT Low Cost, Complete μP-Compatible 8-Bit DAC, AD558, pp. 1-8.

* cited by examiner

*Primary Examiner* — Adolf Berhane
*Assistant Examiner* — Lakaisha Jackson
(74) *Attorney, Agent, or Firm* — Koppel, Patrick Heyhl & Philpott

(57) ABSTRACT

A voltage regulator comprises first and second bipolar transistors operating at different current densities; a resistor is connected between their bases across which $\Delta V_{BE}$ appears. A third bipolar transistor is connected such that the voltages at the bases of the first and third transistors are equal or differ by a PTAT amount. A current mirror is arranged to balance the collector current of one of the second and third transistors with an image of the collector current of the first transistor when the output node is at a unique operating point. The operating point includes both PTAT and CTAT components, the ratio of which can be established such that the operating point has a desired temperature characteristic. A transistor connected to the output node and driven by the output of the current mirror regulates the output voltage by negative feedback.

31 Claims, 4 Drawing Sheets

TWO-TERMINAL VOLTAGE REGULATOR WITH CURRENT-BALANCING CURRENT MIRROR

BACKGROUND OF THE INVENTION

1. Field of the Invention

This invention relates generally to voltage regulators.

2. Description of the Related Art

A regulated voltage is often required in an integrated circuit (IC). In some instances, a variable current is provided to a voltage regulator circuit within the IC, which must be designed to absorb variations in the current while providing a regulated voltage that does not vary as a function of current or, ideally, temperature.

One such regulator is shown in FIG. 1, which was described in R. J. Widlar, "New Developments in IC Voltage Regulators", IEEE International Solid-State Circuits Conference (1970), p. 158. The regulator is driven with a supply current I. Transistor Qa is operated at a higher current density than transistor Qb, with the differential between the base-emitter voltages of Qa and Qb ($\Delta V_{BE}$) appearing across resistor Rc; $\Delta V_{BE}$ will increase with increasing temperature, therefore making it proportional-to-absolute-temperature (PTAT). If Qa and Qb have high current gains, the voltage across Rb will be proportional to $\Delta V_{BE}$, and thus also PTAT. Qc serves as a gain stage that regulates the output voltage $V_{ref}$ at a voltage equal to the drop across Rb, plus the emitter-base voltage of Qc, which is complementary-to-absolute-temperature (CTAT). That is:

$$V_{ref} = \frac{Rb}{Rc}\Delta V_{BE} + V_{BE,Qc}$$

This equation can be shown to imply that $V_{ref}$ will be temperature compensated when it is equal to the bandgap voltage of silicon extrapolated to 0° K. For the circuit shown in FIG. 1, $V_{ref}$ is equal to the bandgap voltage when Qa and Qb operate at a 10:1 current ratio.

This circuit does have some shortcomings, however. As shown, $V_{ref}$ is limited to a value no greater than the bandgap voltage. In addition, changes in I will change the current in Qc, as well as the currents in Qa and Qb, causing a small departure from the nominal $V_{ref}$ value.

SUMMARY OF THE INVENTION

A voltage regulator is presented which overcomes the problems noted above, providing a tightly regulated temperature compensated output voltage which can be greater than the bandgap voltage, while requiring a relatively small number of components.

The present voltage regulator comprises first and second bipolar transistors arranged to operate at different current densities. A first resistor is connected between the transistors such that the difference between their base-emitter voltages ($\Delta V_{BE}$) appears across it. A second resistor is connected between an output node and the first transistor such that it conducts the current in the first resistor and the first transistor. A third bipolar transistor is connected to conduct a current which varies with the voltage at the base of the first transistor, and the circuit is arranged such that the voltages at the bases of the first and third bipolar transistors are equal or differ by a voltage which is PTAT. A current mirror is arranged to balance the collector current of one of the second and third transistors with an image of the collector current of the first transistor when the output node is at a unique operating point.

When so arranged, the operating point includes both PTAT and CTAT components. The regulator may be arranged to the operating point has a desired temperature characteristic. For example, the circuit can be arranged such that the operating point is temperature invariant to a first order. In addition, the circuit can be arranged such that the operating point is approximately equal to the bandgap voltage, or to a multiple thereof. The voltage regulator preferably includes a transistor which is connected to the output node and is driven by the output of the current mirror, which acts to regulate the output voltage by negative feedback.

These and other features, aspects, and advantages of the present invention will become better understood with regulator to the following drawings, description, and claims.

DETAILED DESCRIPTION OF THE INVENTION

Figure 1:
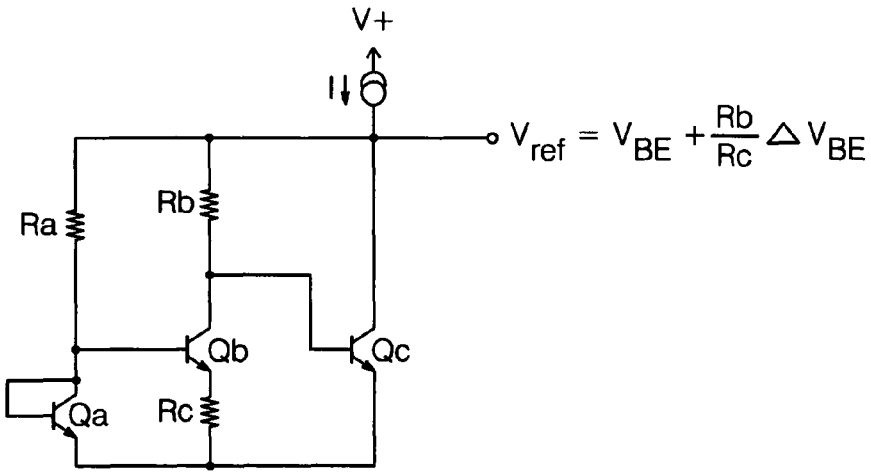
FIG.1 (Prior Art)
FIG. 1 is a schematic diagram of a known voltage regulator.
Figure 2:
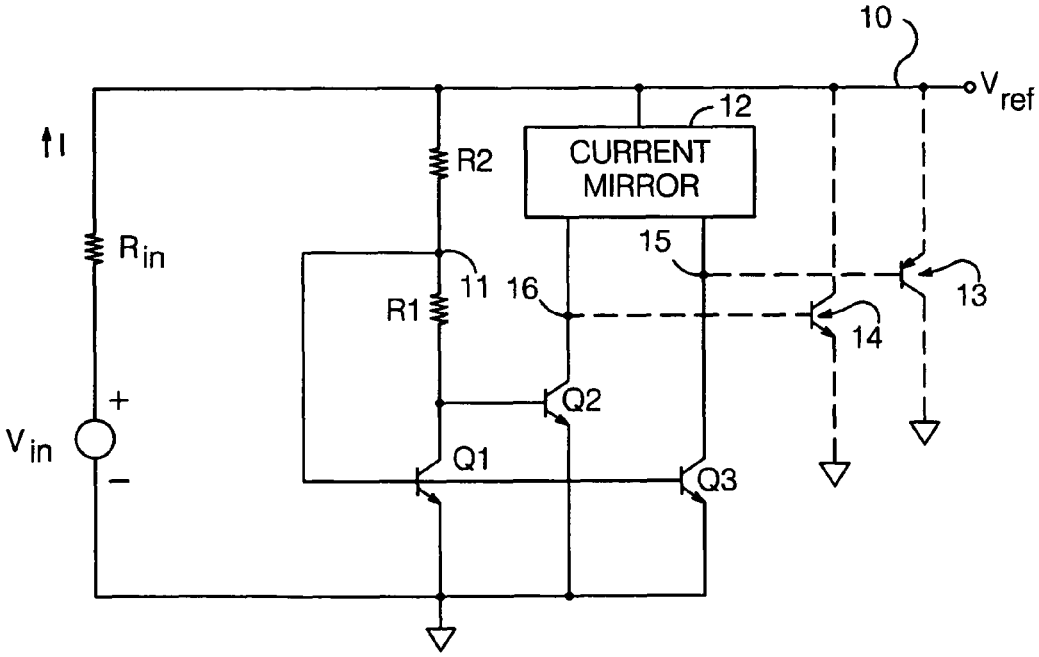
FIG. 2 is a block/schematic diagram illustrating the principles of a voltage regulator in accordance with the present invention.

The principles of a voltage regulator in accordance with the present invention are illustrated in FIG. 2. The circuit is configured as a shunt regulator, though other regulator configurations employing the same principles are possible. The regulator comprises an output node 10 at which the regulator's output voltage $V_{ref}$ is provided; the regulator is driven with a supply current I, the generation of which is represented in FIG. 2 with a resistor $R_{in}$ connected in series between an input voltage $V_{in}$ and output node 10. Bipolar transistors Q1 and Q2 and a resistor R1 are connected such that the difference between the base-emitter voltages of Q1 and Q2 ($\Delta V_{BE}$) appears across R1. A resistor R2 is connected between output node 10 and a node 11 at the junction of R1 and the base of Q1, such that R2 conducts the current in R1 and Q1. The regulator is arranged such that Q1 and Q2 operate at different current densities.

A third bipolar transistor Q3 is connected such that the voltages at the bases of Q1 and Q3 are equal (as shown in FIG. 2) or differ by a voltage which is PTAT, such that Q3 conducts a current which varies with the voltage at the base of Q1. A current mirror 12 is arranged to balance the collector current of Q2 or Q3 with an image of the collector current of Q1 when output node 10 is at a unique operating point.

When so arranged, the voltage at output node 10 includes a component which is PTAT and a component which is CTAT. The ratio of the PTAT and CTAT components can be established such that the operating point has a desired temperature characteristic. For example, the CTAT and PTAT components can be arranged such that the operating point is temperature invariant to a first order, with the operating point made equal to the bandgap voltage or a multiple thereof (discussed in detail below).

The regulator preferably includes a transistor (13 or 14) which is connected to output node 10 and is driven by the output of current mirror 12 such that it acts to regulate $V_{ref}$. A p-type (13) or an n-type (14) transistor is used as needed to provide the negative feedback required to stabilize $V_{ref}$. Transistor 13 or 14 can be a bipolar transistor (as shown), or a FET.

The emitter area of transistor Q2 is preferably larger than that of transistor Q1, so that $\Delta V_{BE}$ is across R1 when Q1 and Q2 operate at equal currents. When so arranged, $\Delta V_{BE}$ is a PTAT voltage given by: $\Delta V_{BE}=\ln(A)*(kT/Q)$, where A is the ratio between the emitter area of Q2 with respect to that of Q1, k is Boltzmann's constant, T is the temperature in degrees Kelvin, and q is the magnitude of electronic charge. Since approximately the same current flows in R2 as R1, the voltage across R2 will be a PTAT image of $\Delta V_{BE}$. For this exemplary embodiment, a balance between the Q1 and Q2 currents is maintained by having transistor Q3 matched to Q1 and connected to have the same base voltage, such that Q1 and Q3 conduct equal currents. Thus, current mirror 12 acts to cause the Q2 and Q3 currents to match when $\Delta V_{BE}$ is across R1.

The mirror can be arranged such that Q2's current drives mirror 12 and Q3 sinks the mirror output, or such that Q3's current drives the mirror and Q2 sinks the mirror output. The point where these currents meet (node 15 or node 16) is very sensitive to the balance between them, and rises or falls to cause transistor 13 or 14 to conduct as needed to maintain the balance and thereby regulate $V_{ref}$.

Figure 3:
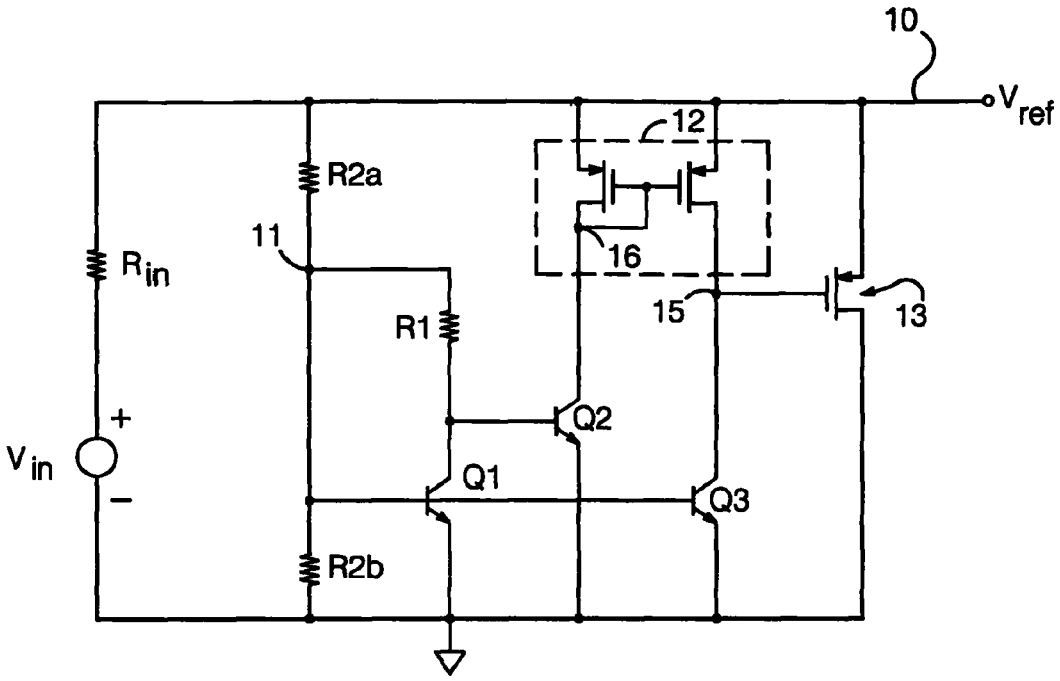
FIG. 3 is a schematic diagram of one possible embodiment of a voltage regulator per the present invention.

Another possible embodiment is shown in FIG. 3. Here, resistor R2 is designated R2*a*, and another resistor R2*b* is connected between the base of Q1 and a circuit common point such that resistor R2*b* forms a voltage divider with R2*a*. This arrangement serves to increase output voltage $V_{ref}$ to a value greater than the bandgap voltage. For example, assume first that the respective resistances of R2*a* and R2*b* are equal and connected in parallel between the base of Q1 and output node 10, thereby delivering a current to the base of Q1. When R2*b* is then moved so that it is connected as shown in FIG. 3, the resulting divider has the same output resistance as the parallel combination, and delivers the same current to the base of Q1 when $V_{ref}$ is at twice the bandgap. Since moving R2*b* as described affects operating conditions such as the transistors' collector voltages, it may be necessary to adjust the values of R2*a* and R2*b* to obtain the best temperature behavior.

The increase in output voltage obtained by this arrangement increases the circuit's headroom, thereby enabling current mirror 12 to use PMOS transistors if desired, and the size of transistor 13 (implemented here as a PMOS FET) can be reduced by a factor of 10 while providing the same sink current level.

The resistances of R2*a* and R2*b* can be easily calculated to provide a desired output voltage greater than a single bandgap voltage. A parameter 'X' is defined as the desired ratio of $V_{ref}$ to the bandgap voltage (or to a voltage slightly greater than the bandgap voltage which compensates for a residual curvature in the $V_{BE}$ vs. temperature characteristic and provides the best temperature behavior over a given temperature range of interest). A parameter 'Y' is defined as the resistance R2 would have in total for the single bandgap case. It can be shown that the resistance of R2*a* is then given by Y*X, and the resistance of R2*b* is given by Y*X/(X−1). As parameter X gets larger, more drive voltage is possible for transistor 13 and consequently a greater available output current (or a smaller requirement for the width of transistor 13 in lower current applications). For example, selecting X to be equal to 4 results in a regulated output voltage $V_{ref}$ of about 5V; the added headroom so provided enables transistor 13 to be much smaller.

As $V_{in}$ increases from zero, the circuit of FIG. 3 comes to balance at the regulated voltage as follows. When $V_{in}$ is low, the base of Q1 can track $V_{in}$ with a very small current requirement. As such, the voltage drop across resistor R1 is negligible and Q1, Q2, and Q3 all have about the same base voltage. As a result of that and the greater emitter area of Q2 (e.g., 8× greater), the current in Q2 is nearly eight times that in Q3 and Q1, though all three currents are very small. As a result, the Q2 current mirrored to node 15 exceeds the Q3 current and transistor 13 is held off, allowing $V_{ref}$ to rise.

As the R2*a*/R2*b* divider voltage (node 11) approaches the active $V_{BE}$ level, the current in Q3 (and by inference in Q1) rises and develops a voltage across R1. This reduces the current ratio between Q2 and the other transistors. As $V_{ref}$ rises, the current in Q2 continues to rise until it peaks at about e times the Q1, Q3 current. Beyond that point, the voltage across R1 reduces the drive to Q2 and its current falls to meet that of Q3 and Q1. When that happens, Q3 is able to pull down on node 15 and control the gate of transistor 13. Any further increase in $V_{ref}$ will continue to reduce the Q2 current while increasing the Q3 current, causing transistor 13 to be driven to sink any additional current into the $V_{ref}$ node.

Figure 4:
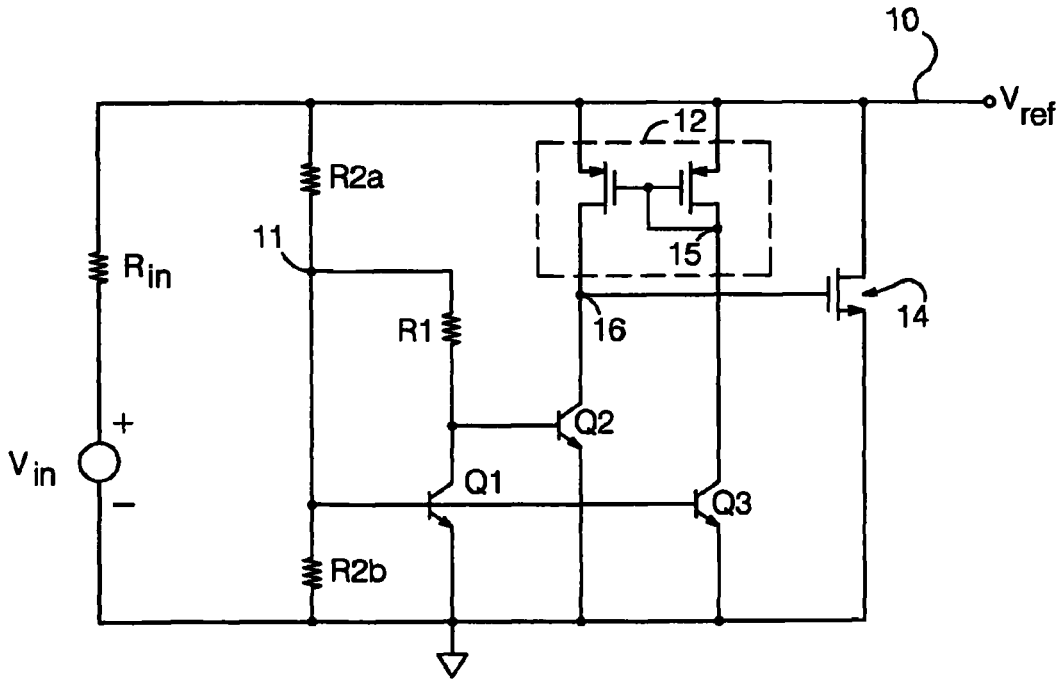
FIG. 4 is a schematic diagram of another possible embodiment of a voltage regulator per the present invention.

Another possible embodiment is shown in FIG. 4. The present circuit comes to balance and regulates the output voltage when the currents in Q2 and Q3 match (or are at least in a certain ratio, as discussed below). As such, current mirror 12 can be arranged to either mirror the Q2 current to Q3 (as in FIG. 3), or mirror the Q3 current to Q2, as shown in FIG. 4. Now, the signal indicating balance, and thus used to drive the feedback transistor, is at node 16. This change reverses the sense of the feedback signal, but this can be resolved by using an n-type transistor, such as the NMOS FET shown, to drive the output node. This is generally beneficial, since the NMOS needed to supply a given load current will be smaller than the corresponding PMOS of the previous circuits.

As noted above, it is required that the current densities in Q1 and Q2 be different. This can be provided by either making the emitter area of Q2 greater than that of Q1, or establishing a desired ratio between the transistors' respective collector currents. The latter option can be accommodated by setting the input/output current ratio for current mirror 12 to a value greater than one. The ratio can be set to, for example, increase the current density ratio between Q1 and Q2 to provide a larger $\Delta V_{BE}$ value, or to enable Q1, Q2 and Q3 to all be the same size. The mirror FETs are preferably relatively long channel devices, to help insure matching and manufacturability.

In some applications, it is desirable to conserve operating current of the regulator. This can be done by increasing the size of R1, which reduces the minimum operating current of the regulator, although at the cost of large value resistors for R2*a* and R2*b* which must be scaled in proportion.

Figure 5:
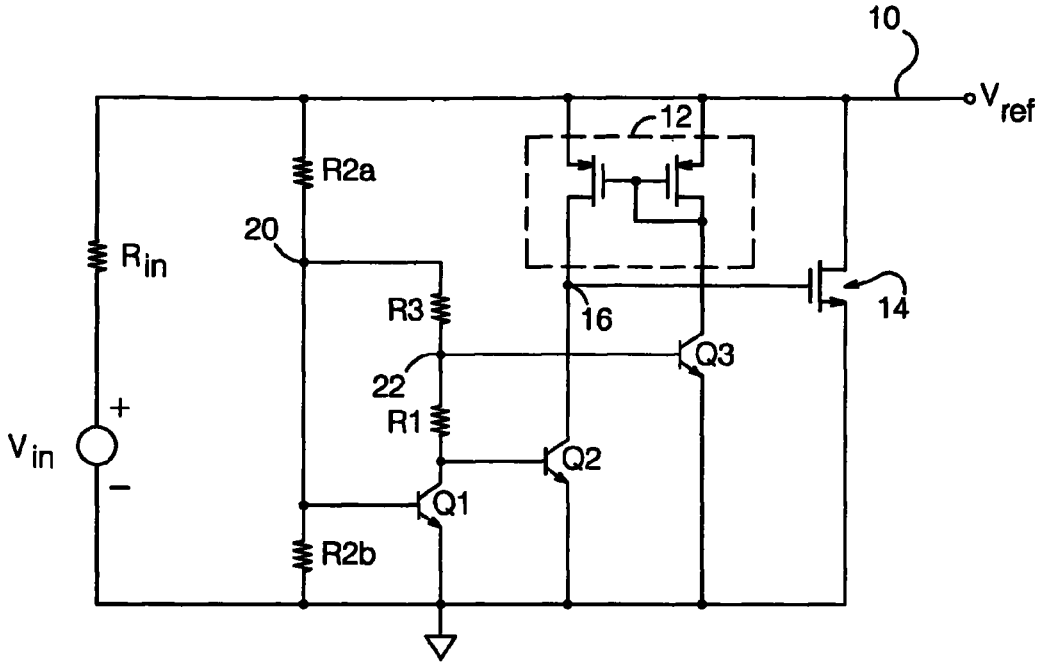
FIG. 5 is a schematic diagram of another possible embodiment of a voltage regulator per the present invention.

As noted above, the present regulator can be arranged such that the voltages at the bases of Q1 and Q3 are equal (as shown in FIGS. 2-4) or differ by a voltage which is PTAT. One possible embodiment of the latter case is shown in FIG. 5. Here, an additional resistor R3 is connected between a node 20 at the junction of Q1, R2*a* and R2*b*, and a node 22 at the top of R1. Since the Q1 collector current flowing in R1 is PTAT, it will also be PTAT in the new R3; therefore, the base of Q3 can be connected to node 22, reducing the Q3 current in a very predictable way. Since the headroom is sufficient to enable the feedback transistor to be a CMOS FET which requires no base current, Q2 and Q3 can be operated at reduced currents.

Since a large part of the operating current in the embodiments shown in FIGS. 2-4 has been due to Q2 and Q3, this change enables the minimum operating current to be nearly halved.

If there is a need to minimize the size of Q2, the scheme described above using a mismatched current mirror to set the current density ratio between Q2 and Q3 is compatible with the repositioned base of Q3.

Referring back to FIG. 2, each of Q1, Q2 and Q3 has an approximately equal base current $i_b$, each of which flows through resistor R2. The base currents split at node 11 at the junction of R1 and R2*a*, with $2*i_b$ flowing to Q1 and Q3, and $1*i_b$ flowing through resistor R1 to Q2. With these base currents present, the voltage drop across R2 will depend on $\Delta V_{BE}$, the resistor ratio R2/R1, and the base currents through the resistors. Thus, the base currents modify the voltage drop across R2, and thereby affect the value of $V_{ref}$ and the temperature compensation.

The voltage across R2 including the effect of base current is given by:

$$V_{R2} = \frac{R2}{R1}\Delta V_{BE} + 2 * R2 * i_b.$$

The base currents through the resistors cause output voltage $V_{ref}$ to rise by $2*i_b*R2$ volts. By including the base current, the output voltage can be written as:

$$V_{ref} = V_{BE} + \frac{R2}{R1}\Delta V_{BE} + 2 * R2 * i_b.$$

As base current decreases with increasing temperature, the $2*i_b*R2$ voltage acts like a voltage source with a negative temperature coefficient. Therefore, $V_{ref}$ looks like the sum of the ideal output voltage and a voltage source with negative temperature coefficient.

One way in which the effect of base current on $V_{ref}$ may be reduced is now described. When base current is neglected, the voltage across R2 is given by $$V_{R2} = \frac{R2}{R1}\Delta V_{BE}.$$

Rearranging this equation:

$$\frac{V_{R2}}{\Delta V_{BE}} = \frac{R2}{R1},$$

which implies that the voltage drop across R2 is independent of base current when the voltage ratio $$\frac{V_{R2}}{\Delta V_{BE}}$$

equals the resistor ratio R2/R1. By inspection, the voltage ratio $$\frac{V_{R2}}{\Delta V_{BE}} \text{ is given by:}$$

-continued $$\frac{V_{R2}}{\Delta V_{BE}} = \frac{R2(i_c + 3i_b)}{R1(i_c + i_b)}$$

Figure 6:
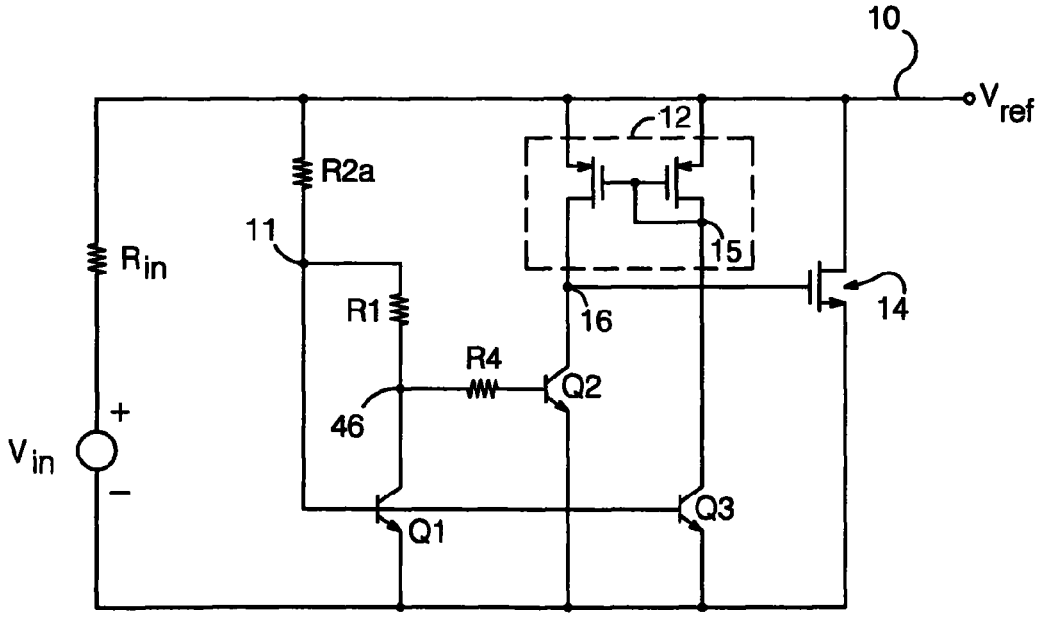
FIG. 6 is a schematic diagram of another possible embodiment of a voltage regulator per the present invention.

Because there is more base current through R2 than through R1, the voltage across R2 becomes dependent on the base current. FIG. 6 shows a modification of the FIG. 2 circuit with added resistor R4, connected between a node 46 at the junction of the Q1 collector and R1, and the base of Q2. Since the current through R4 is the base current of Q2, the voltage developed across the resistor is $R4*i_b$ volts. With added resistor R4, the voltage ratio $$\frac{V_{R2}}{\Delta V_{BE}}$$

becomes:

$$\frac{V_{R2}}{\Delta V_{BE}} = \frac{R2(i_c + 3i_b)}{R1(i_c + i_b) + R4(i_b)}$$

By setting this equation equal to R2/R1 and solving for R4, R4 equals 2*R1. Thus, when the value of R4 is 2*R1, the voltage across R2 is independent of the base current. Thus, adding resistor R4 with a resistance value of 2*R1 compensates for the effect of base currents, making $V_{ref}$ less dependent upon beta. This technique may also be employed to the regulator embodiments shown in FIGS. 3-5.

A regulator as described herein has numerous applications. One possible application is as part of an undervoltage lockout (UVLO) circuit, in which an output is produced that indicates when a monitored voltage falls below a predetermined threshold. One way in which this may be done is by operating the regulator open loop, and using the resulting overdrive conditions to indicate when $V_{ref}$ is above or below the bandgap voltage.

Figure 7:
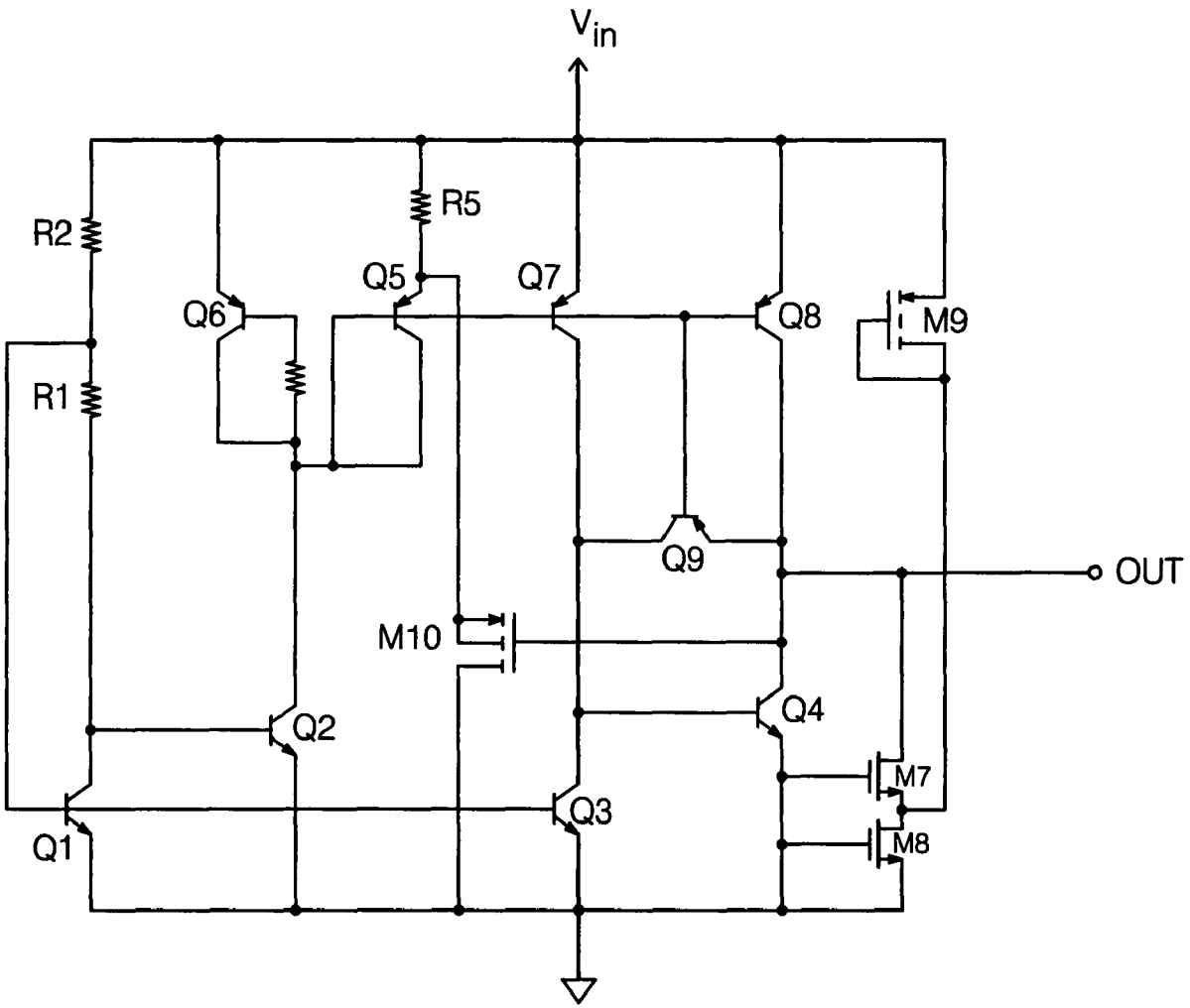
FIG. 7 is a schematic diagram of one possible embodiment of an undervoltage lockout circuit which employs a voltage regulator in accordance with the present invention.

One possible implementation of such an UVLO circuit is shown in FIG. 7. For proper UVLO operation, it is desirable, though not essential, to have some hysteresis between the on and off thresholds. That is, as the input voltage rises, the circuit should hold off its output until some predetermined turn-on threshold is reached, and then signal that fact. However, if the input falls, slightly, the output should remain on until the input falls below some voltage, smaller than the turn-on threshold, by the amount of the hysteresis.

The basic arrangement of Q1, Q2, Q3, R1 and R2 is as described above; however, the current mirror has been complicated somewhat by the addition of some switched elements to produce the hysteresis. Also, here, the control signal at the collector of Q3 drives a transistor Q4, the collector of which is the circuit's switched output OUT.

A passive pulldown or pullup means is preferably used to keep the output in a known state when the input ($V_{in}$) is below the activation voltages of the devices capable of determining the state of OUT. In FIG. 7, this function is provided by two native NMOS FETs (M7, M8) connected between the output node and circuit common, which conduct a small current at zero gate voltage to pull down the output. Since the upper limit of current these devices may supply is poorly defined, the two FETs are cascoded and their intermediate node is pulled up once the input is above a "safe" voltage, preferably set by a PMOS threshold (M9). At this voltage and above, the bipolar transistors should be on by enough for Q4 to hold down the output. Other possible passive pulldown or pullup means include JFETs operated at $I_{dss}$, or very large resistors.

Starting from a low input voltage, OUT should be held low by M7 and M8, and so M10 should have a low gate voltage and begin to sink current from R5 as $V_{in}$ rises. This will hold off the diode-connected Q5 so that the current mirror consists of Q6 as input device and outputs from Q7 and Q8.

Initially as $V_{in}$, rises, the Q2 current will greatly exceed the Q3 current so that the equal outputs of Q7 and Q8 are resolved by Q4 as a low collector voltage at OUT, and this condition will persist from the first available current. When $V_{in}$ approaches the bandgap, the voltage across R1 will reduce the drive to Q2, while the R2 current is mirrored to Q3. When the Q2 and Q3 currents are equal, the base drive for Q4 disappears and OUT is pulled high by Q8.

At the same time, M10 is driven off, permitting Q5 and R5 to load the mirror and reduce the proportion of Q2 current driving Q3 and the base of Q4. As a result, $V_{in}$ must fall enough to restore the difference in Q2 and Q3 to the amount diverted by Q5 and R5. At that point, the Q7 current will exceed the Q3 current and the difference will drive Q4, which will drive OUT back to the low, starting condition. Transistor Q9 serves as a clamp which prevents Q8 from bottoming and stealing mirror current.

Note that the circuit of FIG. 7 can be adapted to higher threshold voltages by splitting R2 into two resistors as shown in FIG. 3. Also note that the technique of adding a resistor to compensate for the effect of base currents, as described above and shown in FIG. 6, can also be beneficially employed in a UVLO circuit as described herein.

Note that embodiments similar to those described herein, but using opposite polarity active devices, are also contemplated.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A voltage regulator circuit, comprising:

an output node at which said circuit's output voltage is provided;

a supply current coupled to said output node;

a first bipolar transistor;

a second bipolar transistor, said first and second bipolar transistors arranged to operate at different current densities;

a first resistor connected between said transistors such that the difference between the base-emitter voltages of said first and second bipolar transistors ($\Delta V_{BE}$) appears across said first resistor;

a second resistor having its first terminal directly connected to said output node and its second terminal connected to the base of said first bipolar transistor such that said second resistor conducts the current in said first resistor and said first bipolar transistor;

a third bipolar transistor having its base directly connected to the base of said first bipolar transistor; and a current mirror comprising first and second transistors, each of which has first, second and third terminals and is arranged to conduct current between said first and second terminals in response to a voltage applied to said third terminals, both of said first terminals directly connected to said output node and both of said second terminals directly connected to respective ones of said second and third bipolar transistors, said current mirror arranged to balance the collector current of one of said second and third bipolar transistors with an image of the collector current of said first bipolar transistor when said output node is at a unique operating point.

2. The voltage regulator circuit of claim 1, wherein said circuit is arranged such that said operating point includes a component which is PTAT and a component which is complementary-to-absolute temperature (CTAT), said circuit arranged such that the ratio of said PTAT and CTAT components can be established such that said operating point has a desired temperature characteristic.

3. The voltage regulator circuit of claim 2, wherein said CTAT and PTAT components are arranged such that said operating point is temperature invariant to a first order.

4. The voltage regulator circuit of claim 3, wherein said circuit is arranged such that said operating point is approximately equal to the bandgap voltage of silicon or a multiple thereof.

5. The voltage regulator circuit of claim 1, further comprising a transistor which is connected to said output node and is driven by the output of said current mirror so as to regulate said output voltage by negative feedback.

6. The voltage regulator circuit of claim 5, wherein said first, second and third bipolar transistors have a common polarity, said current mirror arranged to mirror the current conducted by said second bipolar transistor to said third bipolar transistor, said transistor connected to said output node to regulate said output voltage by negative feedback having a polarity opposite that of said first, second and third bipolar transistors.

7. The voltage regulator circuit of claim 5, wherein said first, second and third bipolar transistors have a common polarity, said current mirror arranged to mirror the current conducted by said third bipolar transistor to said second bipolar transistor, said transistor connected to said output node to regulate said output voltage by negative feedback having the same polarity as said first, second and third bipolar transistors.

8. The voltage regulator circuit of claim 1, wherein said voltage regulator circuit is a shunt regulator which regulates the output voltage at said output node with respect to a circuit common point.

9. The voltage regulator circuit of claim 1, wherein said circuit is arranged such that the currents conducted by said first and second transistors are maintained approximately equal, such that the voltage across first resistor $\Delta V_{BE}$ is given by:

$$\Delta V_{BE}=\ln(A)*(kT/Q),$$

where A is the ratio between the emitter area of said second bipolar transistor with respect to the emitter area of said first bipolar transistor, k is Boltzmann's constant, T is the temperature in degrees Kelvin, and q is the magnitude of electronic charge.

10. The voltage regulator circuit of claim 1, wherein said circuit is arranged such that the currents conducted by said first and second transistors are maintained approximately equal, such that the voltage across first resistor $\Delta V_{BE}$ is given by:

$$\Delta V_{BE}=\ln(A)*(kT/Q),$$

where A is the ratio between the emitter area of said second bipolar transistor with respect to the emitter area of said third bipolar transistor, k is Boltzmann's constant, T is the temperature in degrees Kelvin, and q is the magnitude of electronic charge.

11. The voltage regulator circuit of claim 1, further comprising a third resistor connected between the base of said first bipolar transistor and a circuit common point such that said second and third resistors form a voltage divider that enables said output voltage to be greater than the bandgap voltage and equal to a value established by the resistances of said second and third resistors.

12. A voltage regulator circuit, comprising:

an output node at which said circuit's output voltage is provided;

a supply current coupled to said output node;

a first bipolar transistor;

a second bipolar transistor, said first and second bipolar transistors arranged to operate at different current densities;

a first resistor connected between said transistors such that the difference between the base-emitter voltages of said first and second bipolar transistors ($\Delta V_{BE}$) appears across said first resistor;

a second resistor connected between said output node and the base of said first bipolar transistor such that said second resistor conducts the current in said first resistor and said first transistor;

a third bipolar transistor connected to conduct a current which varies with the voltage at the base of said first transistor, the voltages at the bases of said first and third bipolar transistors being equal or differing by a voltage which is proportional to absolute temperature (PTAT);

a current mirror arranged to balance the collector current of one of said second and third transistors with an image of the collector current of said first transistor when said output node is at a unique operating point; and a third resistor connected between the base of said first bipolar transistor and a circuit common point such that said second and third resistors form a voltage divider that enables said output voltage to be greater than the bandgap voltage and equal to a value established by the resistances of said second and third resistors;

wherein said first resistor is connected between the collector of said first transistor and a first node, further comprising a fourth resistor connected at its first terminal to the junction of the base of said first transistor and said second resistor and at its second terminal to said first node, the base of said third bipolar transistor connected to said first node such that the voltage at the base of said third bipolar transistor differs from the voltage at the base of said first bipolar transistor by a PTAT voltage such that the ratio of the currents conducted by said first and third bipolar transistors is invariant to a first order.

13. The voltage regulator circuit of claim 11, wherein a 'X' is a desired ratio of said output voltage to the bandgap voltage and 'Y' is the resistance that said second resistor would require in order for said regulator to produce an output voltage equal to the bandgap voltage of silicon in the absence of said third resistor, the resistance of said second resistor given by Y*X, and the resistance of said third resistor given by Y*X/(X−1).

14. The voltage regulator circuit of claim 1, wherein said first, second and third bipolar transistors have a common polarity, said current mirror comprising FETs having a polarity opposite that of said first, second and third bipolar transistors.

15. The voltage regulator circuit of claim 1, wherein said current minor has an associated input current and output current and is arranged to provide a desired ratio between said input and output currents, said current minor arranged to provide a ratio other than one and thereby effect said different current densities in said first and second bipolar transistors.

16. The voltage regulator circuit of claim 1, wherein the emitter areas of said first, second and third bipolar transistors are approximately equal.

17. A voltage regulator circuit, comprising:

an output node at which said circuit's output voltage is provided;

a supply current coupled to said output node;

a first bipolar transistor;

a second bipolar transistor, said first and second bipolar transistors arranged to operate at different current densities;

a first resistor connected between said transistors such that the difference between the base-emitter voltages of said first and second bipolar transistors ($\Delta V_{BE}$) appears across said first resistor;

a second resistor connected between said output node and the base of said first bipolar transistor such that said second resistor conducts the current in said first resistor and said first transistor;

a third bipolar transistor connected to conduct a current which varies with the voltage at the base of said first transistor, the voltages at the bases of said first and third bipolar transistors being equal or differing by a voltage which is proportional to absolute temperature (PTAT); and a current mirror arranged to balance the collector current of one of said second and third transistors with an image of the collector current of said first transistor when said output node is at a unique operating point;

wherein said first resistor is connected between the collector and base of said first bipolar transistor, further comprising a third resistor connected between the collector of said first bipolar transistor and the base of said second bipolar transistor, said third resistor sized such that the variation of said output voltage with the beta values of said first, second and third bipolar transistors is reduced.

18. The voltage regulator circuit of claim 17, wherein the resistance of said third resistor is approximately twice the resistance of said first resistor.

19. The voltage regulator circuit of claim 1, wherein the emitter areas of said first and third bipolar transistors are approximately equal and the emitter area of said second bipolar transistor is greater than that of said first and third transistors.

20. The voltage regulator circuit of claim 1, wherein said supply current coupled to said output node is sourced by an external voltage to be monitored, further comprising comparator circuitry coupled to said regulator circuit which detects when the voltage at said output node is less than said unique operating point.

21. A voltage regulator circuit, comprising:

an output node at which said circuit's output voltage is provided;

a supply current coupled to said output node;

a first bipolar transistor;

a second bipolar transistor, said first and second bipolar transistors arranged to operate at different current densities;

a first resistor connected between said transistors such that the difference between the base-emitter voltages of said first and second bipolar transistors ($\Delta V_{BE}$) appears across said first resistor;

a second resistor connected between said output node and the base of said first bipolar transistor such that said second resistor conducts the current in said first resistor and said first transistor;

a third bipolar transistor connected to conduct a current which varies with the voltage at the base of said first transistor, the voltages at the bases of said first and third bipolar transistors being equal or differing by a voltage which is proportional to absolute temperature (PTAT);

a current mirror arranged to balance the collector current of one of said second and third transistors with an image of the collector current of said first transistor when said output node is at a unique operating point;

wherein said supply current coupled to said output node is sourced by an external voltage to be monitored, further comprising comparator circuitry coupled to said regulator circuit which detects when the voltage at said output node is less than said unique operating point; and wherein said current mirror is arranged to mirror the current conducted by said second bipolar transistor to said third bipolar transistor, said comparator circuitry having an output and comprising:

a fourth transistor connected between the output of said comparator circuitry and a circuit common point and driven by the output of said current mirror; and a fifth transistor connected to minor the current conducted by said second bipolar transistor to said fourth transistor, the junction of said fourth and fifth transistors being the output of said comparator circuitry, such that the output of said comparator circuitry is pulled down by said fourth transistor when said output node is less than said unique operating point and is pulled up by said fifth transistor when said output node is greater than said unique operating point.

22. The voltage regulator circuit of claim 21, wherein said comparator circuitry further comprises loading circuitry arranged to reduce the proportion of said second bipolar transistor current mirrored to said third bipolar transistor when the output of said comparator circuitry is pulled up by said fifth transistor, thereby introducing hysteresis into the output of said comparator circuitry.

23. A shunt voltage regulator, comprising:

an output node at which said regulator's output voltage is provided;

a supply current coupled to said output node;

a first resistor having its first terminal directly connected to said output node and its second terminal connected to a first node;

a second resistor connected between said first node and a second node;

a third resistor connected between said first node and a circuit common point;

a first bipolar transistor having its collector-emitter circuit connected between said second node and said circuit common point and its base connected to said first node;

a second bipolar transistor having its collector-emitter circuit connected between a third node and said circuit common point and its base connected to said second node, said first and second bipolar transistors arranged to operate at different current densities with the difference between the base-emitter voltages of said first and second bipolar transistors ($\Delta V_{BE}$) appearing across said second resistor;

a third bipolar transistor having its collector-emitter circuit connected between a fourth node and said circuit common point and arranged to conduct a current which varies with the voltage at the base of said first transistor, the voltages at the bases of said first and third bipolar transistors being equal;

a current mirror connected between said third and fourth nodes and arranged to balance the collector current of one of said second and third transistors with an image of the collector current of said first transistor when said output node is at a unique operating point which includes a component which is proportional-to-absolute temperature (PTAT) and a component which is complementary-to-absolute temperature (CTAT); and a transistor which is connected to said output node and is driven by the output of said current mirror so as to regulate said output voltage by negative feedback;

such that said first and third resistors form a voltage divider that enables said output voltage to be greater than the bandgap voltage of silicon, at a value established by the resistances of said first and third resistors.

24. The shunt regulator of claim 23, wherein said first, second and third bipolar transistors have a common polarity, said current minor arranged to minor the current conducted by said second bipolar transistor to said third bipolar transistor, said transistor connected to said output node to regulate said output voltage by negative feedback being a FET having a polarity opposite that of said first, second and third bipolar transistors.

25. The voltage regulator circuit of claim 23, wherein said first, second and third bipolar transistors have a common polarity, said current mirror arranged to mirror the current conducted by said third bipolar transistor to said second bipolar transistor, said transistor connected to said output node to regulate said output voltage by negative feedback being a FET having the same polarity as that of said first, second and third bipolar transistors.

26. A shunt voltage regulator, comprising:

an output node at which said regulator's output voltage is provided;

a supply current coupled to said output node;

a first resistor having its first terminal directly connected to said output node and its second terminal connected to a first node;

a second resistor connected between said first node and a circuit common point;

a third resistor connected between said first node and a second node;

a fourth resistor connected between said second node and a third node;

a first bipolar transistor having its collector-emitter circuit connected between said third node and said circuit common point and its base connected to said first node;

a second bipolar transistor having its collector-emitter circuit connected between a fourth node and said circuit common point and its base connected to said third node, said first and second bipolar transistors arranged to operate at different current densities with the difference between the base-emitter voltages of said first and second bipolar transistors ($\Delta V_{BE}$) appearing across said third and fourth resistors;

a third bipolar transistor having its collector-emitter circuit connected between a fifth node and said circuit common point and arranged to conduct a current which varies with the voltage at said second node, the voltages at the bases of said first and third bipolar transistors differing by a voltage which is proportional to absolute temperature (PTAT) such that the ratio of the currents conducted by said first and third bipolar transistors is invariant to a first order;

a current minor connected between said fourth and fifth nodes and arranged to balance the collector current of one of said second and third transistors with an image of the collector current of said first transistor when said output node is at a unique operating point which includes a component which is PTAT and a component which is complementary-to-absolute temperature (CTAT); and a transistor which is connected to said output node and is driven by the output of said current mirror so as to regulate said output voltage by negative feedback;

such that said fourth resistor reduces the minimum operating current of said regulator and said first and second resistors form a voltage divider that enables said output voltage to be greater than the bandgap voltage of silicon, at a value established by the resistances of said first and second resistors.

27. An undervoltage lockout (UVLO) circuit, comprising:

a first node to which a voltage to be monitored (Vin) is coupled;

a first bipolar transistor;

a second bipolar transistor, said first and second bipolar transistors arranged to operate at different current densities;

a first resistor connected between said transistors such that the difference between the base-emitter voltages of said first and second bipolar transistors ($\Delta V_{BE}$) appears across said first resistor;

a second resistor connected between said first node and the base of said first bipolar transistor such that said second resistor conducts the current in said first resistor and said first transistor;

a third bipolar transistor connected to conduct a current which varies with the voltage at the base of said first transistor, the voltages at the bases of said first and third bipolar transistors being equal or differing by a voltage which is proportional to absolute temperature (PTAT);

a current mirror arranged to minor the current conducted by said second bipolar transistor to said third bipolar transistor, said current mirror balancing the collector currents of said second and third bipolar transistors when said first node is at a unique operating point;

comparator circuitry having an output and comprising:

a fourth transistor connected between the output of said comparator circuitry and a circuit common point and driven by the output of said current minor; and a fifth transistor connected to minor the current conducted by said second bipolar transistor to said fourth transistor, the junction of said fourth and fifth transistors being the output of said comparator circuitry, such that the output of said comparator circuitry is pulled down by said fourth transistor when said output node is less than said unique operating point and pulled up by said fifth transistor when said output node is greater than said unique operating point; and loading circuitry arranged to reduce the proportion of said second bipolar transistor current mirrored to said third bipolar transistor when the output of said comparator circuitry is pulled up by said fifth transistor, thereby introducing hysteresis into the output of said comparator circuitry.

28. The UVLO circuit of claim 27, wherein said loading circuit comprises:

a sixth transistor connected to minor the current conducted by said second bipolar transistor;

a third resistor connected between said sixth transistor and said first node, the junction of said sixth transistor and said third resistor being a second node; and a seventh transistor connected between said second node and said circuit common point and driven by the output of said comparator circuitry such that said seventh transistor is off and said sixth transistor and third resistor load said current mirror and thereby reduce the proportion of said second bipolar transistor current mirrored to said third bipolar transistor when the output of said comparator circuitry is pulled up by said fifth transistor, and such that said seventh transistor is on and conducts the current in said third resistor when the output of said comparator circuitry is pulled down by said fourth transistor.

29. The UVLO circuit of claim 27, wherein said operating point is approximately equal to the bandgap voltage of silicon or a multiple thereof.

30. The UVLO circuit of claim 27, further comprising a passive pulldown means which pulls the output of said comparator circuitry toward the potential at said circuit common point when said voltage to be monitored is below the activation voltages of the devices capable of determining the state of the output of said comparator circuitry.

31. The voltage regulator circuit of claim 1, wherein said first and second transistors are FETs, the sources of said FETs directly connected to said output node and the drains of said FETs connected to respective ones of said second and third bipolar transistors.

* * * * *